US009576440B2

(12) United States Patent
Keilwert

(10) Patent No.: US 9,576,440 B2
(45) Date of Patent: Feb. 21, 2017

(54) GAMING MACHINE WITH CARRYOVER FEATURE UNITS ASSOCIATED WITH PARTICULAR SYMBOLS

(71) Applicant: GTECH Canada ULC, Moncton (CA)

(72) Inventor: Stefan Keilwert, Lannach (AT)

(73) Assignee: IGT Canada Solutions ULC, Moncton (CA)

( * ) Notice: Subject to any disclaimer, the term of this patent is extended or adjusted under 35 U.S.C. 154(b) by 224 days.

(21) Appl. No.: 14/246,988

(22) Filed: Apr. 7, 2014

(65) Prior Publication Data

US 2015/0287267 A1 Oct. 8, 2015

(51) Int. Cl.
*G07F 17/34* (2006.01)
*G07F 17/32* (2006.01)

(52) U.S. Cl.
CPC ..... *G07F 17/34* (2013.01); *G07F 17/326* (2013.01)

(58) Field of Classification Search
CPC ..... G07F 17/32; G07F 17/34; G07F 17/3213
USPC ..... 463/16–20
See application file for complete search history.

(56) References Cited

U.S. PATENT DOCUMENTS 5,980,384 A * 11/1999 Barrie ..... G07F 17/3265 273/138.1
7,371,171 B1 * 5/2008 Englman ..... G07F 17/3244 273/138.2
8,303,393 B2 * 11/2012 Jaffe ..... G07F 17/3239 463/16
8,328,616 B1 * 12/2012 Gomez ..... G07F 17/3267 463/16
8,523,654 B2 9/2013 Nguyen
2003/0176220 A1 * 9/2003 Baerlocher ..... G07F 17/32 463/26
2004/0072606 A1 * 4/2004 Majima ..... G07F 17/32 463/16
2006/0068881 A1 * 3/2006 Casey ..... G07F 17/3265 463/20
2008/0200235 A1 * 8/2008 Yoshizawa ..... G07F 17/34 463/20
2009/0124338 A1 * 5/2009 Watkins ..... G07F 17/34 463/20
2009/0227356 A1 * 9/2009 Moroney ..... G07F 17/32 463/20
2010/0029369 A1 * 2/2010 Pacey ..... G07F 17/34 463/20

(Continued)

*Primary Examiner* — Omkar Deodhar
*Assistant Examiner* — Shauna-Kay Hall
(74) *Attorney, Agent, or Firm* — Myers Bigel, P.A.

(57) ABSTRACT

In a gaming machine having virtual reels, certain symbols are modified to identify feature units associated with that particular symbol. The feature units carry over for multiple games until extinguished by being used. If a symbol having one or more feature units is involved in a winning combination, the function associated with its feature units, such as an award multiplier, is applied to the player's award. The symbols adjacent to a winning combination of symbols, or the symbols in the winning combination, may be augmented with a feature unit. A symbol accumulating a certain number of feature units may become a wild symbol. By continuing to accumulate feature units over many games, the symbols progressively become more valuable, and the player is incentivized to keep playing the machine. When the player cashes out, the feature units are extinguished.

16 Claims, 4 Drawing Sheets

(56) References Cited

U.S. PATENT DOCUMENTS

| | | | | |
|---|---|---|---|---|
| 2010/0178974 | A1* | 7/2010 | Nguyen | G07F 17/3202 463/20 |
| 2010/0197377 | A1* | 8/2010 | Aoki | G07F 17/3267 463/20 |
| 2012/0122546 | A1* | 5/2012 | Lange | G07F 17/3267 463/20 |
| 2012/0322532 | A1* | 12/2012 | Nauman | G07F 17/34 463/20 |
| 2013/0344939 | A1* | 12/2013 | Aoki | G07F 17/326 463/21 |
| 2014/0329591 | A1* | 11/2014 | Caputo | G07F 17/3267 463/29 |

* cited by examiner

12

First spin.
No win

| | | | | |
|---|---|---|---|---|
| J | J | A | K | Q |
| % | K | # | 10 | & |
| K | % | Q | & | J |
| * | & | K | Q | @ |

Fig. 2

Second spin.
Win.

| | | | | |
|---|---|---|---|---|
| Q | J | A | K | Q |
| % | % | % | 10 | & |
| A | 10 | Q | & | J |
| @ | K | J | Q | @ |

Fig. 3

70

Enhance
surrounding
symbols
by one unit

| | | | | |
|---|---|---|---|---|
| Q +1 | J +1 | A +1 | K | Q |
| % | % | % | 10 | & |
| A +1 | 10 +1 | Q +1 | & | J |
| @ | K | J | Q | @ |

Fig. 4

Third spin. Win. Units are added to surrounding symbols and accumulated.

| | | | | |
|---|---|---|---|---|
| % | 10 | Q | K | Q |
| A (+2) | K (+1) | J (+1) | 10 | & |
| @ | @ | @ | & | J |
| K (+1) | J (+2) | 10 (+1) | Q | @ |

Fig. 5

Fourth spin. Win involving symbols with units. Function of units applied to winning combination.

| | | | | |
|---|---|---|---|---|
| % | 10 | J | K | Q |
| A (+2) | A | A | 10 | & |
| @ | Q | % | & | J |
| K | K | Q (+1) | Q | @ |

Fig. 6

Units extinguished in winning combination. Surrounding symbols accumulate units.

| | | | | |
|---|---|---|---|---|
| % (+1) | 10 (+1) | J (+1) | K | Q |
| A | A | A | 10 | & |
| @ (+1) | Q (+1) | % (+1) | & | J |
| K | K | Q (+1) | Q | @ |

Fig. 7

Fifth spin. Sufficient number of accumulated units (e.g., 5) creates wild symbol.

| | | | | |
|---|---|---|---|---|
| % | 10 | J | K | Q |
| K +5 | A | A | 10 | & |
| @ | Q | % | & | J |
| K | K | Q | Q | @ |

GAMING MACHINE WITH CARRYOVER FEATURE UNITS ASSOCIATED WITH PARTICULAR SYMBOLS

FIELD OF THE INVENTION

This invention relates to gaming devices, such as video slot machines, and, in particular, to a gaming machine where individual symbols are enhanced by feature units that can be accumulated by the symbols over a plurality of games to cause the player to want to continue playing.

BACKGROUND

Common video slot machines randomly select and display an array of symbols, using virtual reels, then grant an award to a player based on the occurrence of certain symbol combinations across paylines. Typically, the game ends after the symbols are displayed and the award, if any, is granted. No benefit is carried over from game to game, so the player does not become invested in playing that particular gaming machine.

U.S. Pat. No. 8,523,654 describes a game where game rules modify the function of a symbol for a particular game, such as making the symbol wild or causing it to enhance an award. However, such a modification is only for a single game then is extinguished. Therefore, the player does not become invested in the game and is not particularly incentivized to keep playing.

It is known to provide a "continuous" bonus game that carries over for multiple games until the bonus game is won. Therefore, the player has an incentive to keep playing the game since, the longer the player plays, the more likely the player will win the bonus game. However, the bonus game is typically a long term game which is only won infrequently and very slowly progresses with time. In other words, the incentive to keep playing is only marginally increased over time, and any reward for winning the bonus game only comes after a large number of games are played.

What is needed is new gaming feature that is added to a base game (rather than a bonus game), where the feature frequently enhances the award or winning percentage, and where aspects of the feature accumulate over a number of games to progressively increase the player's incentive to keep playing the gaming machine.

SUMMARY

The invention may be implemented by a conventional-platform video slot machine that is suitably programmed. The invention can also be implemented by a home computer or hand-held device playing a slot machine type game.

The base game played on the gaming machine may be a conventional video reel-type game that displays a randomly selected array of symbols, where combinations of symbols across one or more paylines are evaluated by circuitry to determine an award to be granted. The array may be formed by five reels, where four symbols on each reel are displayed when the reels stop (a 5×4 array). In one embodiment, there are horizontal, diagonal, and zig-zag paylines, and consecutive winning symbol combinations starting from the leftmost reel are needed to win an award. The player may bet above a minimum bet per game, where either the awards are directly multiplied by the amount bet or additional paylines are activated.

The base game uses virtual reel strips that can be visually modified from game to game.

In one embodiment, after a winning combination of symbols, such as three like symbols horizontally across a payline, each displayed symbol above and below the winning combination is modified to also display a number, representing accumulated feature units for that particular symbol. In another embodiment, only the symbols involved in the winning combination are augmented with the feature units. The units then attach to that particular symbol on that particular reel strip for subsequent games. If the modified symbol is again involved in a situation that awards a feature unit, the feature units for that symbol are accumulated. For example, a KING symbol on a reel may be initially modified to display a "+1" next to it indicating a single feature unit. After a subsequent reel spin resulting in another feature unit being awarded to the same KING symbol, the KING symbol may be modified to display a "+2" next to it indicating two feature units.

Accordingly, many different symbols will eventually be modified with the feature units, and the feature units will progressively accumulate based on the game rules, essentially increasing the value of the symbols having the feature units.

If a modified symbol is involved in a winning combination, the number of accumulated feature units affects either the award or the value of the symbol itself. For example, for any symbol that accumulates five feature units, that symbol becomes a wild symbol. Alternatively, each feature unit acts as an award multiplier. So generally, the win frequency may be increased and/or the awards may be increased due to a winning combination involving symbols with the accumulated feature units. Any other function of the feature units may apply and, generally, the more feature units associated with a symbol, the more valuable that symbol is when involved in a winning combination.

The paytable is modified accordingly to maintain the target pay-in/pay-out ratio.

After a symbol is involved in a winning combination, its feature units are extinguished.

Since the player does not want to leave the gaming machine with potentially valuable "loaded" symbols, the player is incentivized to keep playing the same gaming machine.

When the player cashes out, all the feature units are extinguished to provide no advantage to the next player.

Other variations are described herein.

BRIEF DESCRIPTION OF THE DRAWINGS

FIG. 2 illustrates the display of virtual reels on the machine of FIG. 1 after a first losing spin.

FIG. 3 illustrates the display of virtual reels on the machine of FIG. 1 after a winning second spin, where the winning combination is highlighted.

FIG. 4 illustrates how the winning symbol combination in FIG. 3 caused the symbols above and below the winning combination to be modified with the feature units. Alternatively, only the symbols in the winning combination are modified with the feature units.

FIG. 5 illustrates the display of virtual reels on the machine of FIG. 1 after a winning third spin where symbols that have been previously modified with the feature units are further modified to identify the accumulation of feature units.

FIG. 6 illustrates the display of virtual reels on the machine of FIG. 1 after a winning fourth spin, where a symbol in the winning combination was previously modified to have two feature units and the award is augmented (e.g., multiplied) due to the feature units.

FIG. 7 illustrates how the feature units of symbols involved in the winning combination of FIG. 6 are extinguished after the feature units are used to augment an award for the winning combination, or used to provide some other benefit to the player. FIG. 7 illustrates how other symbols are modified with the feature units by being adjacent to the winning combination of symbols.

Elements in the various figures that are the same or equivalent are labeled with the same numeral.

DETAILED DESCRIPTION

Although the invention can typically be implemented by installing a software program in most types of modern video gaming machines, one particular gaming machine platform will be described in detail.

Figure 1A:
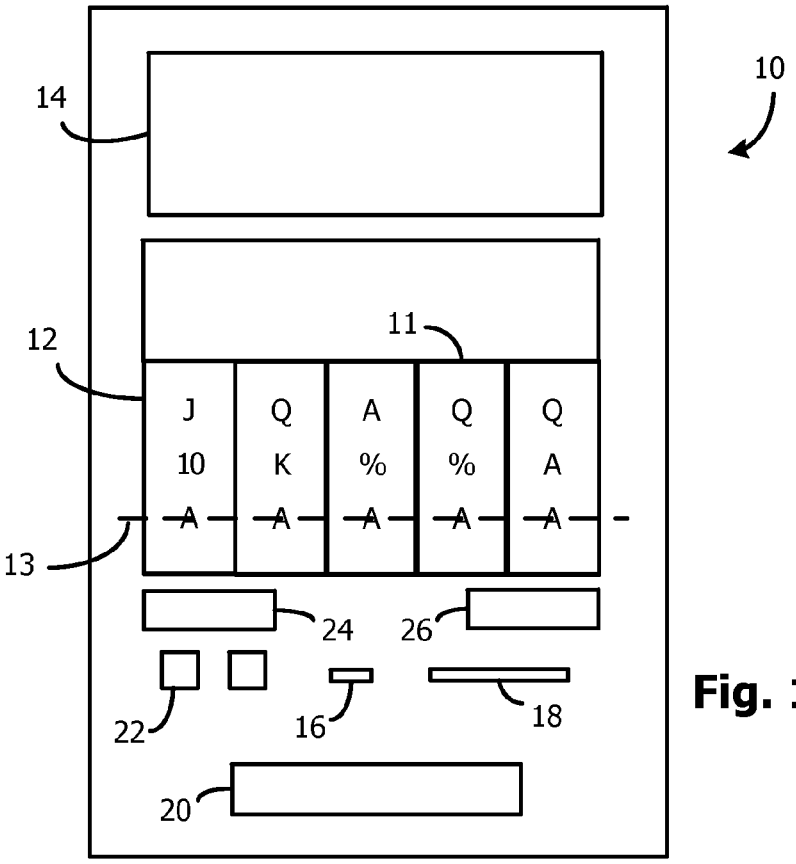
FIG. 1A illustrates a gaming machine that displays a base game where feature units associated with particular symbols are accumulated, in accordance with one embodiment of the present invention.

FIG. 1A illustrates a video gaming machine 10 that incorporates the present invention. The machine 10 includes a bottom display 12 that may be a thin film transistor (TFT) display, a liquid crystal display (LCD), a cathode ray tube (CRT), or any other type of display. In FIG. 1A, the base game shown in display 12 is the conventional random selection of a 5×3 array of symbols, displayed on five virtual reels 11, where an award is granted based on symbol combinations across activated paylines, such as payline 13. In one embodiment, bets above the minimum bet activate additional paylines, including horizontal and zig-zag paylines. In another embodiment, all paylines are activated with a single bet, and the awards are multiplied proportional to the amount bet. The base game can be any game, such as a 5×4 array of symbols or any other size or shape array.

A top display 14 is also a video screen, which may be used to display aspects of the game, such as the title, paytable, etc.

A coin slot 16 accepts coins or tokens in one or more denominations to generate credits within the machine 10 for playing games. An input slot 18 accepts various denominations of banknotes or machine-readable tickets, and may output printed tickets for use in cashless gaming. A coin tray 20 receives coins or tokens from a hopper upon a win or upon the player cashing out. Player control buttons 22 include any buttons needed for the play of the games offered by the machine 10 including, for example, a bet button, a max-bet button, a spin reels button, a cash-out button, and any other suitable button. Pressing the bet button multiple times multiplies the bet. Buttons 22 may be replaced by a touch screen with virtual buttons. The buttons or other input interfaces may generally be referred to as player actuator interfaces.

Each bet deducts credits from a bank meter 24 that stores the accumulated credits from wins and the insertion of money. If the player cashes out, all the credits in the bank meter 24 are paid to the player. A game win meter 26 identifies the amount won for the present game.

Figure 1B:
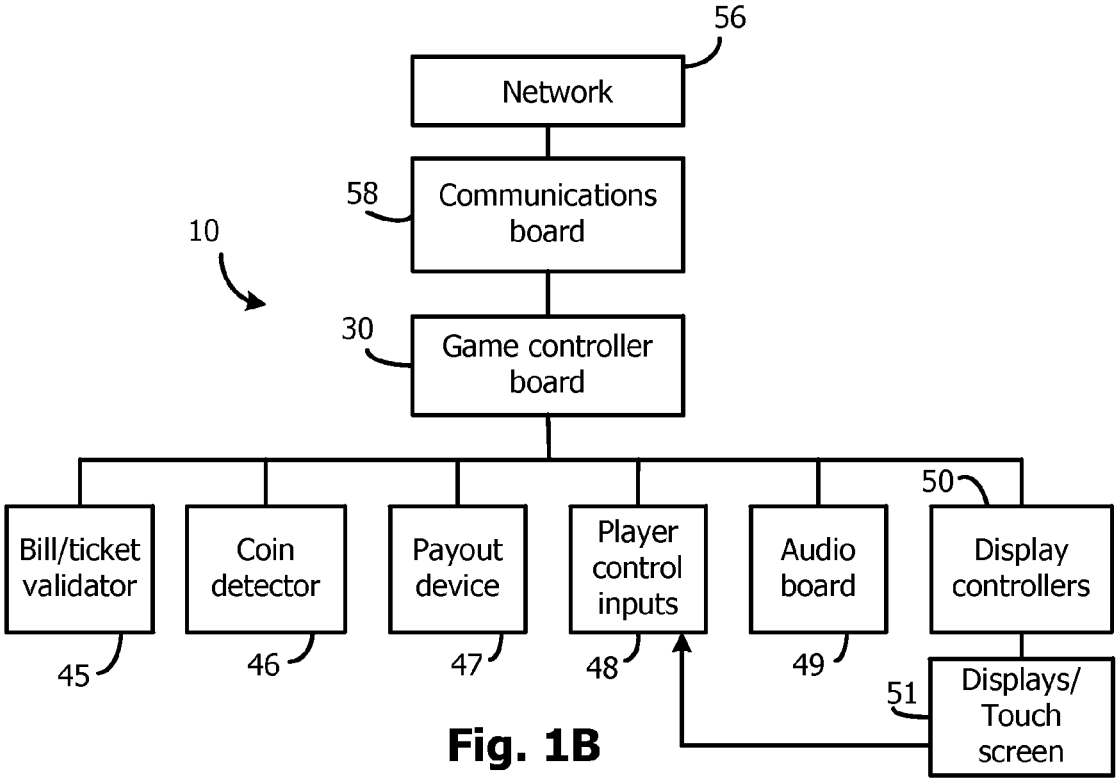
FIG. 1B is a block diagram of key components in the gaming machine of FIG. 1A.

FIG. 1B illustrates basic circuit blocks in the machine 10 of FIG. 1A and portions of a network. A game controller board 30 includes a processor (CPU) that runs the gaming program (including any or all aspects of the feature units) stored in a game control memory, which may be a program read only memory (ROM), such as a compact disk (CD). That is, the game control memory stores code for directing the processor to execute game operations including, for example, the operations described below with reference to FIG. 9. The processor associated with the game controller board 30 may include a single processor or a plurality of processors. The program ROM may include a pseudo-random number generator program for selecting symbols and for making any other random selections. That is, pseudo-random number generator code may be stored in the game control memory and may be executed by the processor to select symbols and make other random selections. At least the active portion of the gaming program may be stored in a random access memory (RAM) on the board 30 for access by the processor. A paytable ROM on the board 30 detects the outcome of the base game and identifies awards to be paid to the player, including awards modified by the feature units. A bill/ticket validator 45 and coin detector 46 add credits for playing games. A payout device 47 pays out an award to the player in the form of coins or a printed ticket at the end of a game or upon the player cashing out. Player control inputs 48 receive push-button or touch screen inputs for making player selections. An audio board 49 sends signals to the speakers. A display controller 50 receives commands from the processor or network and generates signals for the various displays 51.

A memory included in the machine 10 is needed to store data generated based on the results of one or more past spins. This memory may, for example, be the same memory that stores the gaming program (i.e., it may be the game control memory), or it may be a different memory component. As will be described below with reference to FIG. 9, the outcome of a past spin may influence the outcome of a present spin. A present spin is defined to be a spin occurring after the past spin. The memory enables the result of the past spin to affect the result of the present spin since some data about past spins may be logged in the memory. That is, when the processor detects that a winning combination is the outcome of a spin (at step 62 of FIG. 9), the processor then stores data in the memory (at step 68) regarding the symbols that were near the symbols forming the winning combination. Such data may be referred to as bonus symbol identification information. This process will be described in greater detail below with reference to step 68 of FIG. 9.

In at least some embodiments, the information stored in memory about past spins may associate a symbol with a feature unit (e.g., "+1"). The feature unit may be a number or other metric representing an amount by which an associated symbol has been enhanced or advanced towards a goal (e.g., the goal may be a bonus level or award associated with a predetermined feature unit (e.g., "+5")). Such feature units may be determined based on the outcome of one or more past spins and may be stored in the memory.

The memory storing the data generated based on past spins (such as the feature units associated with various symbols) is coupled with the processor to allow the processor to access the memory and to use such data when determining the outcome of a spin. This process is described in greater detail below with reference to steps 64 and 66 of FIG. 9.

The memory storing the data generated based on past spins is an electronic component such as a flash memory, hard disk drive (HDD), solid state drive (SSD).

Modern gaming machines are connected within a network for remote monitoring of the machines. The game controller board 30 transmits and receives signals to and from a network 56 via a communications board 58. The network 56 includes servers and other devices that monitor the linked gaming machines.

The below description of the game refers to steps in the method illustrated in the flowchart of FIG. 9 and to certain screen displays shown in FIGS. 2-8. The method may be performed by the processor of the game controller board 30. More particularly, processor-executable instructions are stored in memory associated with the video gaming machine 10, such as game control memory. Such instructions are readable by the processor and these instructions configure the processor to perform the method illustrated in FIG. 9. The instructions may also be referred to as code.

Figures 8, 9:
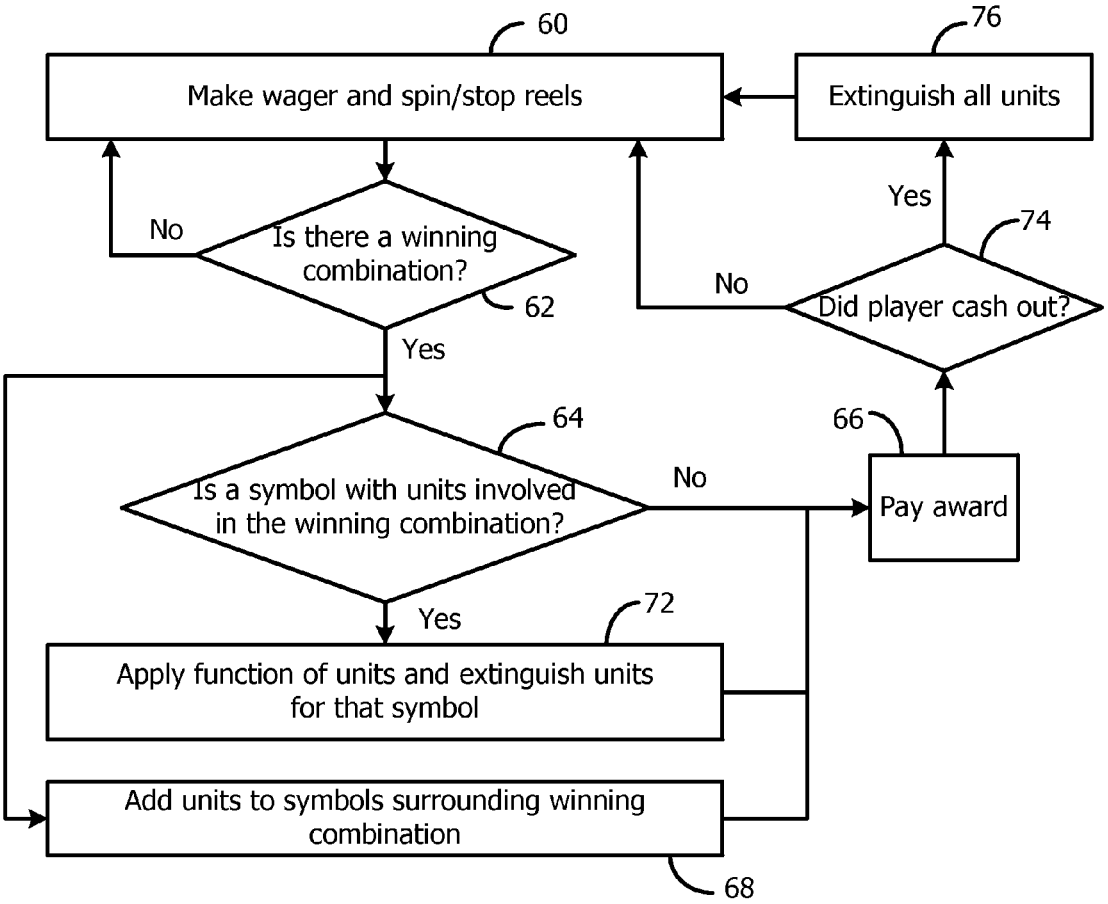
FIG. 8 illustrates the display of virtual reels on the machine of FIG. 1 after a winning fifth spin, where the accumulation of five feature units causes the KING symbol to become a wild card.
FIG. 9 is a flowchart illustrating various steps in a game employing one embodiment of the invention.

In step 60 of FIG. 9, the player makes a wager and touches the appropriate button to spin and randomly stop the five virtual reels. That is, in response to activation of the appropriate player actuator interface (e.g., a button), a signal is provided to the processor. The signal indicates a player making a wager. The processor detects this signal and the gaming routine is carried out by the processor in the game controller board 30 or other processing system such as in a remote server. More particularly, the gaming routine is initiated by spinning and stopping virtual reels, having symbols, to generate an array of symbols. The symbols are displayed on a display screen.

In step 62, the final symbol positions are compared to the winning symbol combinations in a paytable (e.g., a ROM in the game controller board 30).

In the screen display of FIG. 2, on the first spin, no winning symbol combination was obtained. The player then plays a second game by making a wager and spinning the reels.

In the screen display of FIG. 3, on the second spin, the player obtained the winning symbol combination of three "%" symbols from left to right.

In step 64, it is determined if any of the symbols involved in the winning symbol combination has any feature units associated with it. Step 64 may be performed by retrieving such information from a memory which stores data associating feature units with symbols. Such data was generated based on one or more past spin and the generation of such information will be discussed in greater detail below in the discussion of step 68. In the example of FIG. 3, the answer is no and the player is then paid an award in accordance with the paytable (step 66).

In step 68, and as shown in FIG. 4, the symbols above and below the winning symbol combination are modified to show a number of feature units 70 (e.g., "+1"). In the example, a single feature unit is added to those six symbols above and below the three % symbols. In another embodiment, certain winning combinations may augment the symbols with different numbers of feature units. In another embodiment, only the symbols in the winning combination are modified with the feature units.

In one embodiment, the arrangement of the symbols on each of the five virtual reels does not change. In another embodiment, each symbol position is its own virtual reel, so there are effectively 20 reels independently spun in the 5×4 matrix. In another embodiment, even the symbol to the right of the winning symbol combination is also augmented with the feature unit.

FIG. 5 illustrates the results of a third spin, which resulted in a winning combination of three "@" symbols. In the example, the "A" symbol in the first reel from FIG. 4 is again adjacent to the winning symbol combination and has its feature units increased by one unit to +2 units. This also applies to the "J" symbol on the second reel. The other four symbols adjacent to the winning symbol combination are modified to show one feature unit per symbol.

FIG. 6 illustrates the results of a fourth spin in which the "A" symbol of FIG. 5 that was modified to identify +2 feature units is part of a winning symbol combination.

In addition to augmenting a displayed symbol with a feature unit, at step 68, a memory is updated based on the outcome of the spin that occurred at step 60. For example, using the example of FIG. 3, the memory may be updated to associate the six symbols above and below the winning combination with a feature unit. If one or more of those symbols were already associated, in memory, with a feature unit (e.g., in the example of FIG. 4 the "A" symbol was already associated with a "+1" feature unit), then the feature unit for that symbol may be incremented in memory. For example, if one of the symbols was associated with a feature unit of "+1" prior to the spin occurring at step 60, then the memory may be updated so that the symbol is associated with a feature unit of "+2" at step 68.

In step 72 of FIG. 9, the function associated with the "A" symbol having +2 feature units is applied by the processor. In one embodiment, the function is that the award is multiplied, such as by two. In another embodiment, the function is not enabled until at least a certain number of feature units are accumulated by a symbol, such as +5. In another embodiment, all the symbols in the winning symbol combination must have a feature unit in order for the function to be applied. The function may be any function, such as an award multiplier, free spins (such as equal to the sum of the feature units in the winning combination), wild symbols being created, scatter symbols being created, a bonus game, or any other function. In at least some embodiments, the processor may perform step 72 by retrieving data associating feature units with symbols from the memory. For example, the processor may, at step 72, consult the memory to determine the number of feature units associated with the symbols in the winning combination.

Also in step 72, once the feature unit is used to obtain the benefit of the function, the applied feature units are extinguished by the processor. More particularly, the memory associating symbols with feature units is updated to remove at least some such associations. FIG. 7 shows the +2 feature units for the "A" symbol being extinguished after the award was doubled. FIG. 7 also shows the symbols adjacent the winning symbol combination being modified with an augmented feature unit.

In one embodiment, only symbols that are displayed can win a feature unit. So, if a winning symbol combination occurred at the bottom position of the reels, only the symbols above the winning combination would win a feature unit. In one embodiment, only wins across a horizontal pay line cause the feature units to be applied to the adjacent symbols.

FIG. 8 illustrates the results of a fifth spin where the function of +5 feature units turns the associated symbol into a wild symbol. Accordingly, the "K" symbol with the +5 feature units acts as a wild symbol to win the award for three "A" symbols.

In step 74 of FIG. 9, it is determined by the processor whether the player cashed out. If so, then in step 76, all the accumulated feature units are extinguished by the processor to reset the game. That is, the memory associating symbols with feature units is updated to remove such associations. For example, the feature units may be deleted from the memory. In this way, there is no benefit for a potential player to wait to play any machine.

Since winning symbol combinations are a frequent occurrence, the player will quickly accumulate feature units for many of the symbols. Since the reel strips are virtual, there may be any number of symbol positions on a single reel strip, so the probability of any particular symbol being involved in a winning combination is selectable by the designer. The player will view her playing time as an investment into the machine since the feature units will continue to pile up until extinguished by a win. Therefore, the player is reluctant to cash out since the chances of benefitting from a feature unit increase the longer the player plays. In this way, the feature units benefit both the player and the house. The paytable and other aspects of the game are designed by the designer to provide a target long term payout/pay-in ratio of, for example, 97% or any other typical ratio. The player however is more excited about the game, even with the base awards typically lowered, since there is a continuous secondary game being played with the feature units.

The gaming system has been described above as a dedicated physical gaming machine in a casino or other establishment. However, the gaming machine 10 may be a suitable generic computer or mobile device (smartphone, tablet, etc.) connected to a network/server via the internet and programmed to carry out the inventive methods. The screen images of FIGS. 2-8 may be those on any computing device. The gaming machine 10 of FIG. 1 may itself be a screen image in a virtual casino. Player control may be by touch screen, a mouse, a joystick, or other means. The gaming system may access a gaming site or a social website (e.g., Facebook) via the internet, wherein the remote gaming site controls various aspects of the game and allows remote players to participate in games using a virtual gaming machine. The player's inputs may be transmitted to a remote server and the results displayed to the player's display screen. For example, a player's mobile computing system (e.g., a smartphone) may detect winning symbol combinations by signals from the server informing the computing system that a winning combination has occurred. For gaming via the internet, the wagering would typically be by credit card or accessing an existing account. Awarding the player may be by crediting the player's account. For portable computing devices, Near Field Communications (NFC), such as Bluetooth, may be used as a player interface to play on an actual or virtual gaming machine 10.

Those skilled in the art may write the appropriate software to carry out the invention without undue experimentation. The hardware used may be conventional.

The term "random" used herein refers to pure random as well as pseudo-random.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. A method performed by a gaming device, the method comprising:

providing a paytable memory identifying a winning symbol combination displayed by the gaming device;

receiving, by the gaming device, a monetary wager made by a player via a wager input device as part of the gaming device;

receiving a game initiation signal by the player controlling a game initiation device, as part of the gaming device, to initiate a game;

under control of a processing system that includes a processor and a memory that includes program code that causes the processor to execute operations, spinning and stopping virtual reels, having symbols, to generate an array of symbols, the symbols being displayed on a display screen;

under control of the processing system, granting awards to the player for the winning symbol combination;

under control of the processing system, augmenting first symbols with feature units in response to the winning symbol combination on stopped reels, the feature units having a function that is advantageous to the player, wherein augmenting the first symbols with the feature units does not change a likelihood that the first symbols will be part of the winning symbol combination identified in the paytable memory, and wherein the first symbols are not part of the winning symbol combination when augmented with the feature units;

under control of the processing system, maintaining the feature units associated with the first symbols over a plurality of games until the feature units are extinguished;

under control of the processing system, accumulating the feature units when the first symbols are again augmented with the feature units over the course of the plurality of games;

under control of the processing system, if the winning symbol combination comprises at least one of the first symbols having the associated feature units, and certain criteria regarding the feature units is met, applying the function of the feature units to the winning symbol combination;

under control of the processing system, granting an award to the player for the winning symbol combination while applying the function of the associated feature units; and extinguishing the feature units associated with first symbols involved in the winning symbol combination.

2. The method of claim 1 wherein the augmenting the first symbols with the feature units in response to the winning symbol combination comprises augmenting symbols that are adjacent the winning symbol combination with the feature units.

3. The method of claim 1 wherein the applying the function of the feature units to the winning symbol combination comprises enhancing the award for the winning symbols combination based on a number of feature units associated with symbols in the winning symbol combination.

4. The method of claim 1 further comprising changing a function of any of the first symbols after a certain plurality of feature symbols has been accumulated by the any one of the first symbols.

5. The method of claim 4 wherein changing the function of any of the first symbols after a certain plurality of feature symbols has been accumulated comprises making the any one of the first symbols a wild symbol.

6. The method of claim 1 further comprising extinguishing all feature units upon the player cashing out of the gaming device.

7. The method of claim 1 wherein the augmenting the first symbols with feature units in response to winning symbol combinations comprises modifying an appearance of the first symbols to indicate a number of feature units associated with each of the first symbols.

8. The method of claim 1 wherein the video gaming device is a stand-alone gaming machine.

9. The method of claim 1 wherein the video gaming device is a computing device connected to a server via the Internet.

10. A gaming device comprising:

a display screen;

a paytable memory that identifies a winning symbol combination displayed by the gaming device;

a wager input device, as part of the gaming device, that receives a monetary wager by a player;

a game initiation device, as part of the gaming device, that is controlled by the player to initiate a game;

a processing system programmed to carry out the following operation:

spinning and stopping virtual reels, having symbols, to generate an array of symbols, the symbols being displayed on a display screen;

granting an award to the player for the winning symbol combination;

augmenting first symbols with feature units in response to the winning symbol combination on stopped reels, the feature units having a function that is advantageous to the player, wherein the augmenting the first symbols with the feature units does not change a likelihood that the first symbols will be part of the winning symbol combination identified in the paytable memory, and wherein the first symbols are not part of the winning symbol combination when augmented with the feature units;

maintaining the feature units associated with the first symbols over a plurality of games until the feature units are extinguished;

accumulating the feature units when the first symbols are again augmented with the feature units over the course of the plurality of games;

if a winning symbol combination comprises at least one of the first symbols having the associated feature units, and certain criteria regarding the feature units is met, applying the function of the feature units to the winning symbol combination;

granting the award to the player for the winning symbol combination while applying the function of the associated feature units; and extinguishing the feature units associated with the first symbols involved in the winning symbol combination.

11. The device of claim 10 wherein the augmenting the first symbols with the feature units in response to the winning symbol combination comprises augmenting symbols that are adjacent the winning symbol combination with the feature units.

12. The device of claim 10 wherein the applying the function of the feature units to the winning symbol combination comprises enhancing the award for the winning symbols combination based on a number of feature units associated with symbols in the winning symbol combination.

13. The device of claim 10 further comprising the processing system being programmed to change the function of any of the first symbols after a certain plurality of feature symbols has been accumulated by the any one of the first symbols.

14. The device of claim 10 wherein the processing system is further programmed to extinguish all feature units upon the player cashing out of the gaming device.

15. The device of claim 10 wherein the augmenting the first symbols with feature units in response to winning symbol combination comprises modifying an appearance of the first symbols to indicate a number of feature units associated with each of the first symbols.

16. The device of claim 10 wherein the device is a computing device connected to a server via the Internet.

* * * * *